US009875839B2

(12) United States Patent
Choi et al.

(10) Patent No.: US 9,875,839 B2
(45) Date of Patent: Jan. 23, 2018

(54) MAGNETIC COMPOSITION AND INDUCTOR INCLUDING THE SAME

(71) Applicant: SAMSUNG ELECTRO-MECHANICS CO., LTD., Suwon-Si, Gyeonggi-Do (KR)

(72) Inventors: Youn Kyu Choi, Suwon-Si (KR); Mi Jung Kang, Suwon-Si (KR); Hea Ah Kim, Suwon-Si (KR); Yun Young Yang, Suwon-Si (KR); Jae Yeol Choi, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 215 days.

(21) Appl. No.: 15/000,997

(22) Filed: Jan. 19, 2016

(65) Prior Publication Data

US 2016/0217902 A1 Jul. 28, 2016

(30) Foreign Application Priority Data

Jan. 27, 2015 (KR) ..... 10-2015-0012618

(51) Int. Cl.

| | |
|---|---|
| ***H01F 5/00*** | (2006.01) |
| ***H01F 17/04*** | (2006.01) |
| ***H01F 27/24*** | (2006.01) |
| ***H01F 27/255*** | (2006.01) |
| ***H01F 27/29*** | (2006.01) |
| ***H01F 17/00*** | (2006.01) |

(Continued)

(52) U.S. Cl.

CPC ..... *H01F 27/255* (2013.01); *H01F 17/0013* (2013.01); *H01F 27/292* (2013.01); *H01F 1/14708* (2013.01); *H01F 1/15308* (2013.01)

(58) Field of Classification Search

USPC ..... 336/200, 232, 234

See application file for complete search history.

(56) References Cited

U.S. PATENT DOCUMENTS 8,576,040 B2 * 11/2013 Kim ..... H01F 17/0013 336/177
2008/0129437 A1 * 6/2008 Yoshizawa ..... C22C 38/002 336/220

(Continued)

FOREIGN PATENT DOCUMENTS

KR 10-2013-0064352 A 6/2013
KR 2013-0123252 A 11/2013

(Continued)

OTHER PUBLICATIONS

Korean Office Action issued in Korean Application No. 10-2015-0012618 dated May 23, 2016, with English Translation.

*Primary Examiner* — Elvin G Enad
*Assistant Examiner* — Kazi Hossain
(74) *Attorney, Agent, or Firm* — McDermott Will & Emery LLP

(57) ABSTRACT

A magnetic composition includes: coarse powder containing a non-crystalline iron-based material; medium powder containing a crystalline iron-based material; and fine powder containing nickel. A ratio of the coarse powder and the medium powder is in a range of 65:35 to 80:20, and the amount of the fine powder is in a range of 3 wt % to 7 wt % on the basis of a total weight of the coarse powder and the medium powder.

15 Claims, 3 Drawing Sheets

(51) Int. Cl.
*H01F 1/147* (2006.01)
*H01F 1/153* (2006.01)

(56) References Cited

U.S. PATENT DOCUMENTS

| | | | | |
|---|---|---|---|---|
| 2009/0045905 | A1* | 2/2009 | Nakagawa | H01F 1/26 336/232 |
| 2010/0289609 | A1* | 11/2010 | Liao | H01F 17/04 336/221 |
| 2011/0285486 | A1* | 11/2011 | Maeda | B22F 1/0062 335/297 |
| 2013/0147591 | A1 | 6/2013 | Kim et al. | |
| 2013/0293334 | A1 | 11/2013 | Shin | |
| 2014/0225703 | A1* | 8/2014 | Otake | H01F 1/24 336/221 |
| 2015/0002255 | A1 | 1/2015 | Kim et al. | |
| 2015/0028983 | A1* | 1/2015 | Ryu | H01F 1/15308 336/192 |
| 2015/0155084 | A1* | 6/2015 | Kim | H01F 1/22 174/260 |

FOREIGN PATENT DOCUMENTS

| | | | |
|---|---|---|---|
| KR | 10-1442404 | B1 | 9/2014 |
| KR | 2015-0002172 | A | 1/2015 |

* cited by examiner

MAGNETIC COMPOSITION AND INDUCTOR INCLUDING THE SAME

CROSS-REFERENCE TO RELATED APPLICATION

This application claims the priority and benefit of Korean Patent Application No. 10-2015-0012618 filed on Jan. 27, 2015, with the Korean Intellectual Property Office, the disclosure of which is incorporated in its entirety herein by reference.

BACKGROUND

The present disclosure relates to a magnetic composition and an inductor including the same, and more particularly, to a magnetic composition, an inductor having increased inductance and for use in a high frequency band.

An inductor is a coil component commonly used as an electronic component in electronic devices such as cellular phones and personal computers (PCs). Such an inductor may respond to changes in magnetic flux to generate inductive electromotive force. A magnitude of this magnetic induction is referred to as inductance of the inductor, and inductance is commonly increased in proportion to a cross-sectional area of a core of the inductor, the number of turns of the coil, and magnetic permeability of the core.

Inductors, as electronic components, are commonly divided into wire wound inductors, multilayer inductors, and thin film inductors. In particular, a power inductor is an electronic component performing a smoothing function and a noise removing function in a power supply of a central processing unit (CPU), or the like. As power inductors in which high current flows, in other words, inductors for a power supply, wire wound inductors have mainly been used. Wire wound inductors have a structure in which a copper (Cu) wire is wound around a ferrite drum core. Since the wire wound inductors use a high magnetic permeability/low-loss ferrite core, an inductor having high inductance while having a small size may be manufactured.

Further, since even in the case of decreasing the number of turns of the copper wire, the same level of inductance may be obtained in the high magnetic permeability/low-loss ferrite core, direct current resistance (DC resistance, Rdc) of the copper wire is decreased, which may contribute to decreasing power consumption of a battery.

Multilayer inductors have been mainly used in filter circuits on signal lines, in impedance matching circuits, and the like. Such multilayer inductors are manufactured by printing a coil pattern on ferrite sheets using a metal material such as silver (Ag) in a paste state and stacking a plurality of ferrite sheets on which the coil pattern is printed. Such multilayer inductors were initially commercialized by TDK in 1980, and have been used as surface mounted devices (SMD) for portable radios, and currently, multilayer inductors have been widely used in various electronic devices. Since the multilayer inductors has a structure in which a stereoscopic coil is covered by ferrite, multilayer inductors are inductors capable of decreasing magnetic leakage due to a magnetic shielding effect of the ferrite and which are suitable for high-density mounting on circuit boards.

SUMMARY

An aspect of the present disclosure may provide a magnetic composition increasing inductance and allowing an inductor to be used in a high frequency band.

An aspect of the present disclosure may also provide an inductor for use in a high frequency band while having increased inductance.

An aspect of the present disclosure may also provide a method of manufacturing an inductor for use in a high frequency band while having increased inductance.

According to an aspect of the present disclosure, a magnetic composition may include: coarse powder containing a non-crystalline iron-based material; medium powder containing a crystalline iron-based material; and fine powder containing nickel. A ratio of the coarse powder and the medium powder may be in a range of 65:35 to 80:20. The amount of the fine powder may be in a range of 3 wt % to 7 wt % on the basis of a total weight of the coarse powder and the medium powder.

The coarse powder may contain an iron-chromium-sulfur-carbon (Fe—Cr—S—C)-based material and have a particle size of 25 μm to 80 μm.

The medium powder may have a particle size of 2.5 μm to 5 μm.

The fine powder may contain crystalline or non-crystalline nickel or nickel alloy and have a particle size of 60 nm to 200 nm. The nickel alloy may contain one of iron, cobalt, molybdenum, aluminum, silicon, chromium, tin, boron, or combinations thereof.

According to another aspect of the present disclosure, an inductor may include: a coil part having a winding form; an inductor body containing the magnetic composition as described above and having the coil part embedded therein while both end portions of the coil part are exposed to both end surfaces of the inductor body opposing each other, respectively. First and second external electrodes are provided on the end surfaces of the inductor body connected to the end portions of the coil part, respectively.

The coil part may contain silver or copper.

The coarse powder may contain an iron-chromium-sulfur-carbon (Fe—Cr—S—C)-based material and have a particle size of 25 μm to 80 μm.

The medium powder may have a particle size of 2.5 μm to 5 μm.

The fine powder may contain crystalline or non-crystalline nickel or nickel alloy and have a particle size of 60 nm to 200 nm. The nickel alloy may contain one of iron, cobalt, molybdenum, aluminum, silicon, chromium, tin, boron, or combinations thereof.

The inductor may further include a cover layer provided on side surfaces of the inductor body connecting both end surfaces of the inductor body to each other. The cover layer may contain a material which is the same as that of the inductor body.

According to another aspect of the present disclosure, a method of manufacturing an inductor may include: preparing an inductor body containing the magnetic composition as described above and including a coil part having a winding form which is embedded therein while both end portions of the coil part are exposed to both end surfaces of the inductor body opposing each other, respectively; and forming first and second external electrodes on the end surfaces of the inductor body to be connected to the end portions of the coil part, respectively.

The coarse powder may contain an iron-chromium-sulfur-carbon (Fe—Cr—S—C)-based material and have a particle size of 25 μm to 80 μm.

The medium powder may have a particle size of 2.5 μm to 5 μm.

The fine powder may contain crystalline or non-crystalline nickel or nickel alloy and have a particle size of 60 nm to 200 nm. The nickel alloy may contain one of iron, cobalt, molybdenum, aluminum, silicon, chromium, tin, boron, or combinations thereof.

The coil part may contain silver or copper.

The method may further include forming a cover layer on side surfaces of the inductor body connecting both end surfaces of the inductor body to each other. The cover layer may be formed of a material which is the same as that of the inductor body.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
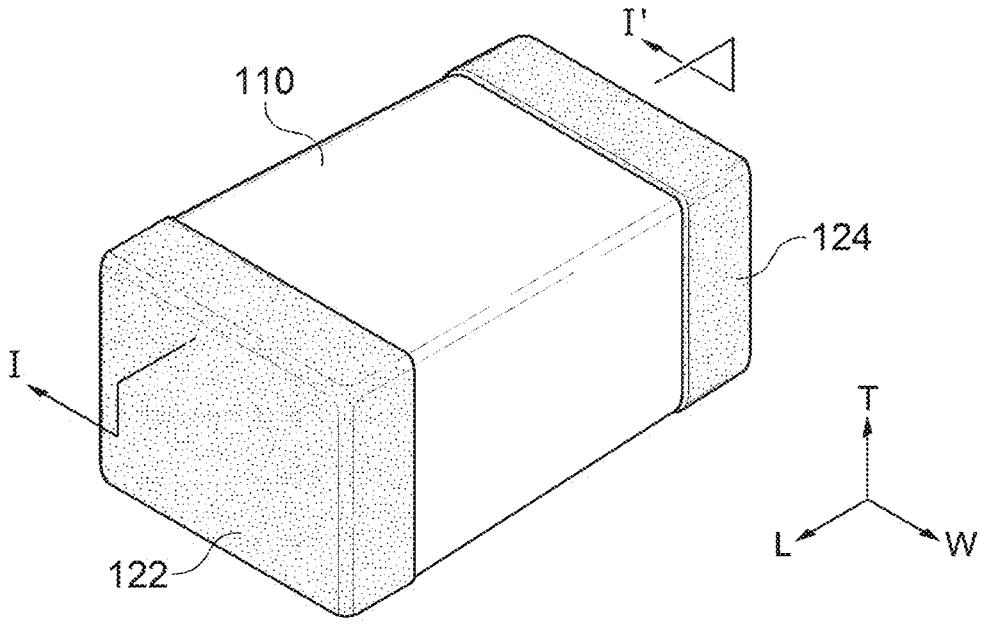
FIG. 1 is a perspective view schematically illustrating an inductor according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
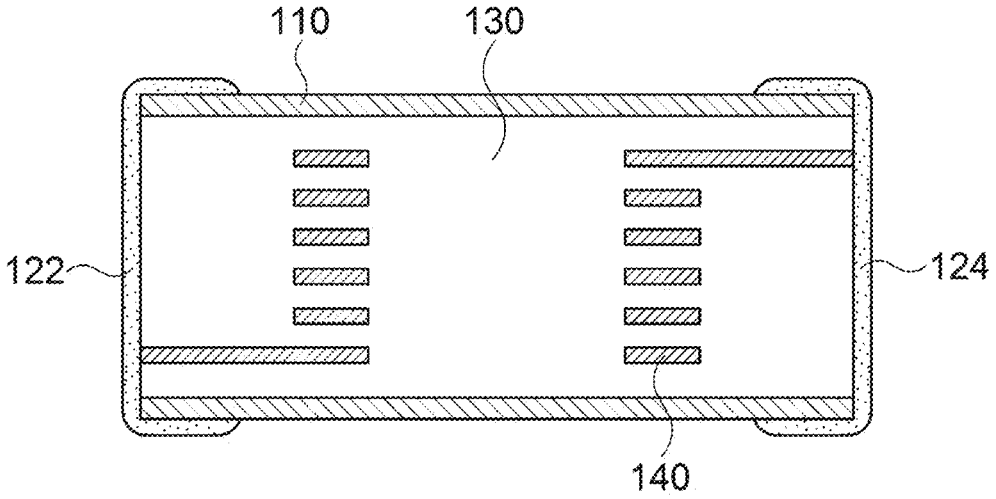
FIG. 2 is a cross-sectional view taken along line I-I' of FIG. 1.

FIG. 1 is a perspective view schematically illustrating an inductor according to an exemplary embodiment in the present disclosure, and FIG. 2 is a cross-sectional view taken along line I-I' of FIG. 1.

Referring to FIGS. 1 and 2, the inductor may include an inductor body 130, a coil part 140 provided in the inductor body 130, and a pair of external electrodes 122 and 124 provided on opposite end portions of the inductor body 130, respectively.

A multilayer power inductor will be described by way of example of the inductor according to the exemplary embodiment, but the example of the inductor is not limited thereto. Electronic components may be implemented as wire wound inductors, multilayer inductors, thin film inductors, capacitors, thermistors, or the like, by changing a structure of the coil part 140.

The inductor body 130 may contain a magnetic composition. The magnetic composition according to an exemplary embodiment may contain coarse powder containing a non-crystalline iron (Fe)-based material, medium powder containing a crystalline iron (Fe)-based material, and fine powder containing nickel (Ni). A ratio of the coarse powder and the medium powder may be in a range of 65:35 to 80:20, and the fine powder may be added in a range of 3 wt % to 7 wt % on the basis of a total weight of the coarse powder and the medium powder. Preferably, in the magnetic composition according to the exemplary embodiment in the present disclosure, the ratio of the coarse powder and the medium powder may be 70:30, and 5 wt % of the fine powder may be added thereto on the basis of the total weight of the coarse powder and the medium powder.

The coarse powder may contain a non-crystalline iron-chromium-sulfur-carbon (Fe—Cr—S—C)-based material. The coarse powder may have a particle size of 25 μm to 80 μm. In order to decrease hysteresis loss of the magnetic composition in a low frequency band and significantly decrease eddy current loss of the magnetic composition in a high frequency band, the coarse powder may have a particle size of 25 μm to 80 μm and contain a non-crystalline iron-chromium-sulfur-carbon (Fe—Cr—S—C)-based material having high insulation properties.

The medium powder may contain a crystalline iron-based material. The medium powder may have a particle size of 2.5 μm to 5 μm. In order to increase saturation current Isat of the magnetic composition, the medium powder may have a particle size of 2.5 μm to 5 μm and contain a crystalline iron-based material, having a high saturation magnetization (Ms) value.

The fine powder may contain a crystalline or non-crystalline nickel or nickel alloy. The fine powder may have a particle size of 60 nm to 200 nm. The nickel alloy may contain one of iron, cobalt (Co), molybdenum (Mo), aluminum (Al), silicon (Si), chromium (Cr), tin (Si), boron (B), or combinations thereof. In order to increase a powder filling rate and a saturation magnetization value of the inductor body 130, the fine powder may have a particle size of 60 nm to 200 nm and contain a crystalline or non-crystalline nickel or nickel alloy, having a high saturation magnetization value.

Since the magnetic composition contains the fine powder containing nickel, having a particle size of 60 nm to 200 nm and a high saturation magnetization value, the powder filling rate and the saturation magnetization value of the inductor body 130 may be increased. Therefore, inductance of the inductor may be increased. In addition, a self-resonance frequency (SRF) of the inductor may be controlled to be in a high frequency band of 100 MHz or more by controlling an amount of added fine powder containing nickel.

Although not illustrated, an insulation layer may be provided between the inductor body 130 and the coil part 140. The insulation layer may be formed of a material containing at least one of epoxy, polyimide (PI), polyamide (PA), or combinations thereof. Alternatively, the insulation layer may be formed by mixing a glass material and low-temperature sintering ceramic powder.

The coil part 140 may be formed in a winding form. The coil part 140 may be formed of silver or copper. Both end portions of the coil part 140 may be exposed to both end surfaces of the inductor body 130 opposing each other. Although not illustrated, coil parts 140 composed of multilayer circuit patterns may be electrically connected to each other by a conductive via penetrating through the insulation layer or/and the inductor body 130.

The first and second external electrodes 122 and 124 may be provided on opposite end surfaces of the inductor body 130 to be connected to both end portions of the coil part 140, respectively.

The inductor may further include a cover layer 110 provided on side surfaces of the inductor body 130 connecting both end surfaces of the inductor body 130 to each other. The cover layer 110 may be formed of the same material as that of the inductor body 130. Alternatively, an insulation layer may be formed to enclose the side surfaces of the inductor body 130 connecting opposite end surfaces thereof to each other.

Figure 3:
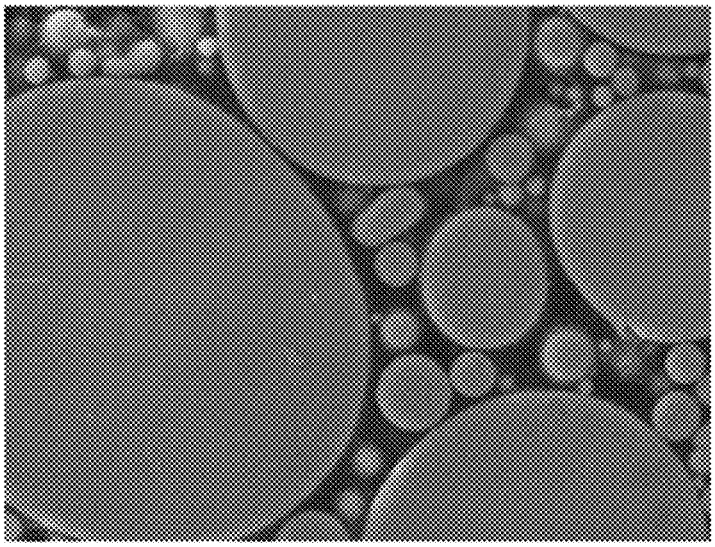
FIGS. 3 and 4 are photographs illustrating a microstructure of a portion of the inductor according to an exemplary embodiment in the present disclosure.
Figure 4:
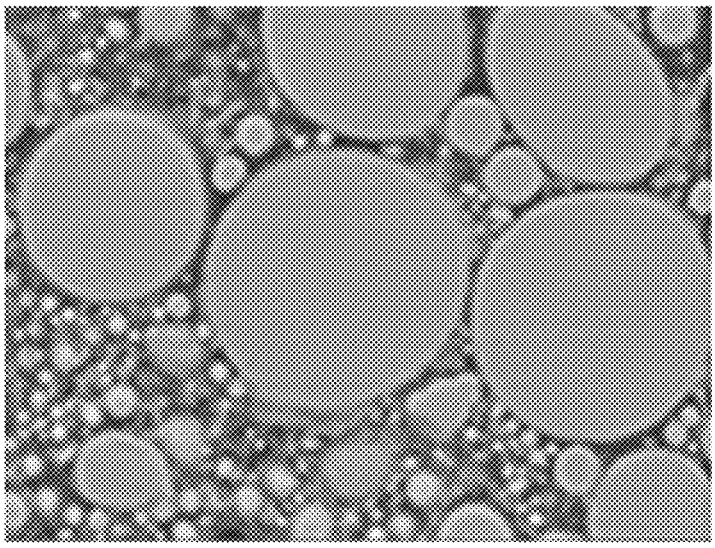

FIGS. 3 and 4 are photographs illustrating a microstructure of a portion of the inductor according to the exemplary embodiment in the present disclosure.

Referring to FIGS. 3 and 4, FIG. 3 is a photograph of a microstructure of an inductor body (130 of FIG. 2) of an inductor formed of a magnetic composition, a mixture obtained by mixing coarse powder containing a non-crystalline iron-chromium-sulfur-carbon (Fe—Cr—S—C)-based material, having a particle size of 25 μm to 80 μm and medium powder containing a crystalline iron-based material, having a particle size of 2.5 μm to 5 μm at a mixing ratio of 70:30, and FIG. 4 is a photograph of a microstructure of an inductor body (130 of FIG. 2) of an inductor formed of a magnetic composition obtained by adding fine powder containing nickel, having a particle size of 60 nm to 200 nm in a range of 3 wt % to 7 wt % on the basis of a total weight of the coarse powder and the medium powder to a mixture in which coarse powder containing a non-crystalline iron-chromium-sulfur-carbon (Fe—Cr—S—C)-based material, having a particle size of 25 μm to 80 μm and medium powder containing a crystalline iron-based material, having a particle size of 2.5 μm to 5 μm are mixed at a mixing ratio of 70:30.

As illustrated in FIGS. 3 and 4, a powder filling rate was high in FIG. 4 illustrating the microstructure of the inductor body formed of a ternary magnetic composition to which fine powder containing nickel, having a particle size of 60 nm to 200 nm is added as compared to the microstructure of the inductor body in FIG. 3, formed of a binary magnetic composition.

Figure 5:
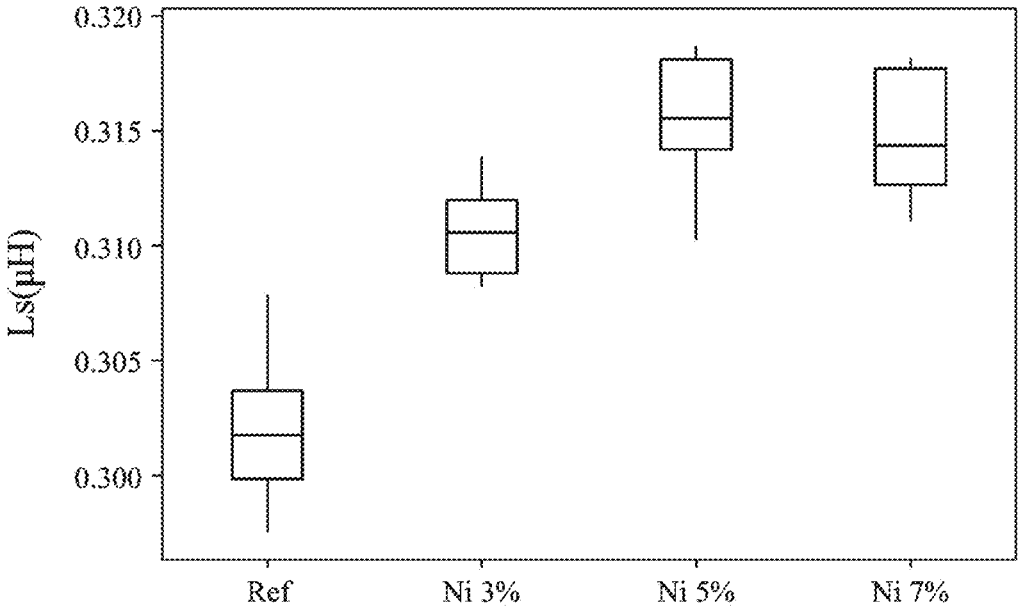
FIG. 5 is a graph illustrating results obtained by measuring inductance of inductors according to an exemplary embodiment in the present disclosure.

FIG. 5 is a graph illustrating results obtained by measuring inductance of inductors according to an exemplary embodiment in the present disclosure.

Referring to FIG. 5, the results are obtained by measuring inductance of inductors including inductor bodies (130 of FIG. 2) in which contents of fine powder containing nickel are different from each other as illustrated in FIGS. 3 and 4. Ref in the graph of FIG. 5 indicates inductance of an inductor including an inductor body formed of the binary magnetic composition of FIG. 3.

As illustrated in FIG. 5, it may be appreciated that as the content of the fine powder containing nickel is increased to 5%, inductance of the inductor is increased. As the fine powder containing nickel is added to the magnetic composition, the powder filling rate of the inductor body is increased as illustrated in FIGS. 3 and 4, and thus, magnetic permeability of the inductor body is increased.

It may be appreciated that as the content of the fine powder containing nickel is increased to be higher than 5%, inductance of the inductor is decreased again.

Further, it may be appreciated that a self-resonance frequency of the inductor including the inductor body formed of the magnetic composition to which the fine powder containing nickel is added is moved to 100 MHz. As the fine powder containing nickel is added to the magnetic composition, the powder filling rate of the inductor body is increased, thereby decreasing parasitic capacitance affecting a resonance frequency and increasing a Q value.

Figure 6:
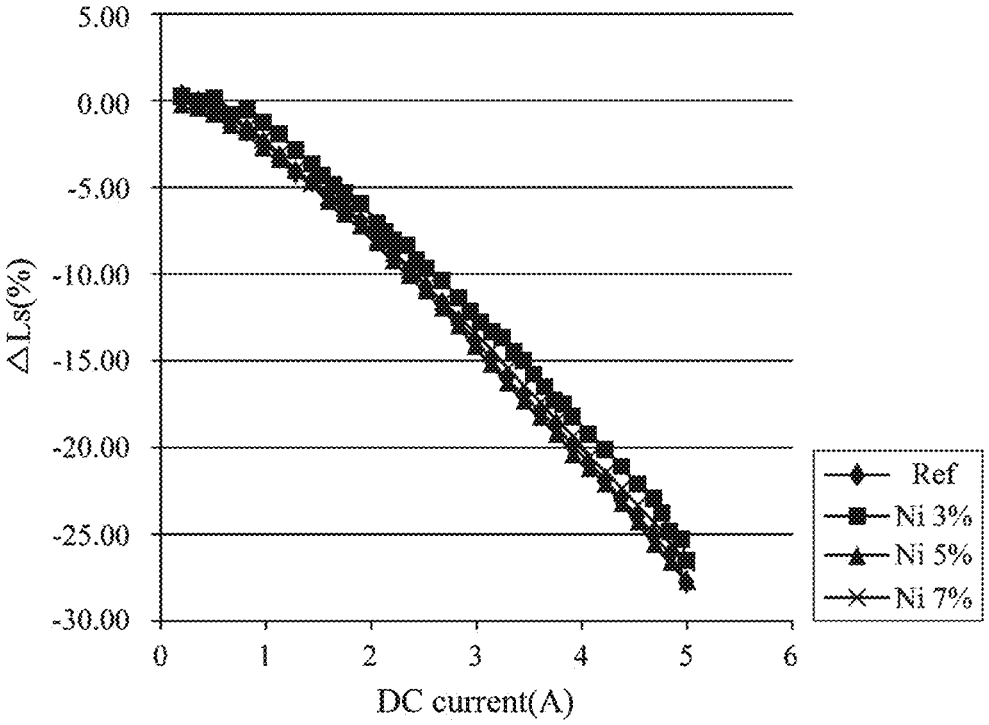
FIG. 6 is a graph illustrating results obtained by measuring inductance change rates of inductors according to an exemplary embodiment in the present disclosure.

FIG. 6 is a graph illustrating results obtained by measuring inductance change rates of inductors according to an exemplary embodiment in the present disclosure.

Referring to FIG. 6, the inductance change rates are varied depending on direct current (DC) applied to the inductors. The inductance may be changed depending on the direct current. That is, as a magnitude of the applied current is increased, eddy current loss is increased, and thus, inductance may be decreased. In this case, the eddy current loss may be increased in proportion to a square of a maximum size of the powder configuring the inductor body. Ref in the graph of FIG. 6 indicates inductance of the inductor including the inductor body formed of the binary magnetic composition of FIG. 3.

It may be appreciated that the fine powder containing nickel having a significantly small particle size as compared to the coarse powder is used in the inductor including the inductor body formed of the magnetic composition according to the exemplary embodiment, whereby eddy current loss may not be increased, but parasitic capacitance may be decreased due to an increase in the powder filling rate of the inductor body, and overall saturation current may be slightly improved due to an increase in the Q value.

As set forth above, according to exemplary embodiments, the fine powder containing nickel is added in a range of 3 wt % to 7 wt % on the basis of the total weight of the coarse powder and the medium powder, such that the powder filling rate of the inductor body of the inductor may be increased. Therefore, the magnetic composition may be advantageous in controlling the self-resonance frequency to be in a high frequency band of 100 MHz or more while increasing inductance of the inductor.

Further, according to exemplary embodiments, the inductor body contains the magnetic composition to which the fine powder containing nickel is added in a range of 3 wt % to 7 wt % on the basis of the total weight of the coarse powder and the medium powder, such that the powder filling rate of the inductor body of the inductor may be increased. Therefore, the inductor may have a self-resonance frequency controlled to be in a high frequency band of 100 MHz or more while having high inductance.

Further, according to exemplary embodiments, the inductor body may be formed of the magnetic composition to which the fine powder containing nickel is added in a range of 3 wt % to 7 wt % on the basis of the total weight of the coarse powder and the medium powder, such that the powder filling rate of the inductor body of the inductor may be increased. Therefore, the method of manufacturing an inductor having a self-resonance frequency controlled in a high frequency band of 100 MHz or more while having high inductance may be provided.

While exemplary embodiments have been shown and described above, it will be apparent to those skilled in the art that modifications and variations could be made without departing from the scope of the present invention as defined by the appended claims.

What is claimed is:

1. A magnetic composition comprising:

coarse powder containing a non-crystalline iron-based material;

medium powder containing a crystalline iron-based material; and fine powder containing nickel, wherein a ratio of the coarse powder and the medium powder is in a range of 65:35 to 80:20, and the amount of the fine powder in the composition is in a range of 3 wt % to 7 wt % on the basis of a total weight of the coarse powder and the medium powder.

2. The magnetic composition of claim 1, wherein a particle size of the medium powder is less than that of the coarse powder and greater than that of the fine powder.

3. The magnetic composition of claim 1, wherein the coarse powder contains an iron-chromium-sulfur-carbon (Fe—Cr—S—C)-based material and has a particle size of 25 μm to 80 μm.

4. The magnetic composition of claim 1, wherein the medium powder has a particle size of 2.5 μm to 5 μm.

5. The magnetic composition of claim 1, wherein the fine powder contains crystalline or non-crystalline nickel or nickel alloy and has a particle size of 60 nm to 200 nm.

6. The magnetic composition of claim 5, wherein the nickel alloy contains one of iron, cobalt, molybdenum, aluminum, silicon, chromium, tin, boron, or combinations thereof.

7. An inductor comprising:

a coil part having a winding form;

an inductor body containing the magnetic composition of claim 1 and having the coil part embedded therein while both end portions of the coil part are exposed to both end surfaces of the inductor body opposing each other, respectively; and first and second external electrodes provided on the end surfaces of the inductor body connected to the end portions of the coil part, respectively.

8. The inductor of claim 7, wherein a particle size of the medium powder is less than that of the coarse powder and greater than that of the fine powder.

9. The inductor of claim 7, wherein the coil part contains silver or copper.

10. The inductor of claim 7, wherein the coarse powder contains an iron-chromium-sulfur-carbon (Fe—Cr—S—C)-based material and has a particle size of 25 μm to 80 μm.

11. The inductor of claim 7, wherein the medium powder has a particle size of 2.5 μm to 5 μm.

12. The inductor of claim 7, wherein the fine powder contains crystalline or non-crystalline nickel or nickel alloy and has a particle size of 60 nm to 200 nm.

13. The inductor of claim 12, wherein the nickel alloy contains one of iron, cobalt, molybdenum, aluminum, silicon, chromium, tin, boron, or combinations thereof.

14. The inductor of claim 7, further comprising a cover layer provided on side surfaces of the inductor body connecting both end surfaces of the inductor body to each other.

15. The inductor of claim 14, wherein the cover layer contains a material which is the same as that of the inductor body.

* * * * *